US005313747A

United States Patent [19]

Sakihara

[11] Patent Number: 5,313,747

[45] Date of Patent: May 24, 1994

[54] COLLAPSIBLE AND EXTENSIBLE PLAYHOUSE

[76] Inventor: Donn L. Sakihara, 1342 F Wilder Ave., Honolulu, Hi. 96822

[21] Appl. No.: 962,909

[22] Filed: Oct. 19, 1992

[51] Int. Cl.[5] ..... F04B 1/346

[52] U.S. Cl. ..... 52/64; 52/70; 446/478; 446/112

[58] Field of Search ..... 52/64, 69-72, 52/79.14; 446/110, 105, 108, 112, 115, 478, 901

[56] References Cited

U.S. PATENT DOCUMENTS

| | | | |
|---|---|---|---|
| 2,057,942 | 10/1936 | Fay | 446/112 |
| 2,883,713 | 4/1959 | Zug | 52/71 |
| 3,231,942 | 2/1966 | O'Brien | 446/478 |
| 3,729,881 | 5/1973 | Disko | 446/105 |
| 3,977,119 | 8/1976 | Nelson | 446/478 |
| 4,569,664 | 2/1986 | Giampetruzzi et al. | 446/110 |
| 4,603,658 | 8/1986 | Gamsey | 52/70 |
| 4,112,633 | 9/1987 | Mitchell | 52/71 |
| 4,964,249 | 10/1990 | Payne | 446/478 |

FOREIGN PATENT DOCUMENTS 2438886 4/1976 Fed. Rep. of Germany ..... 52/79.14

*Primary Examiner*—Carl D. Friedman
*Assistant Examiner*—Winnie Yip
*Attorney, Agent, or Firm*—Leon Gilden

[57] ABSTRACT

A playhouse structure arranged to include a front and rear wall in a parallel orientation relative to one another, having first and second end walls. The first and second end walls are hingedly mounted intermediate their width and are hingedly mounted at each of their sides to the associated front and rear walls to permit projection of the first and second end walls intermediate the front and rear walls, with the roof structure having first and second roof plates hingedly mounted to the front and rear walls respectively and to one another. A modification of the invention includes crown trusses having projections projected through the roof plates and into one of the end walls to provide for a rigid structure.

1 Claim, 5 Drawing Sheets

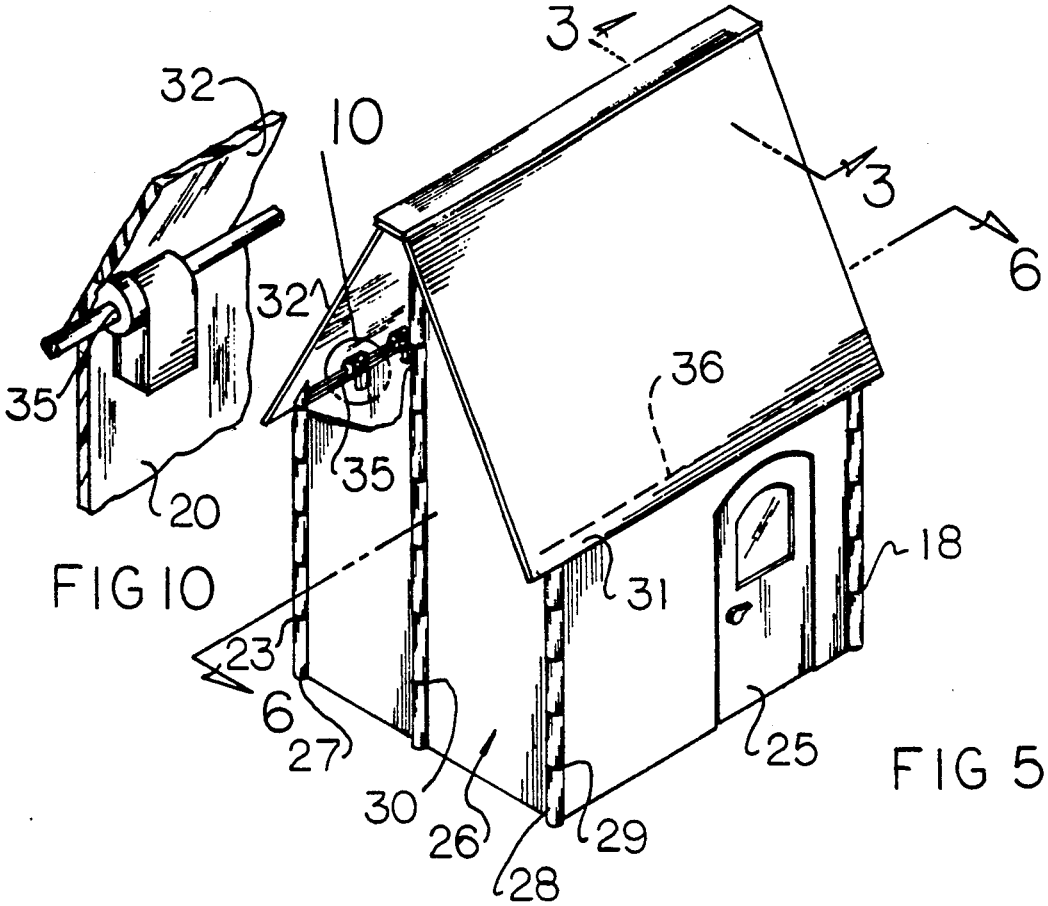
FIG 10
FIG 5
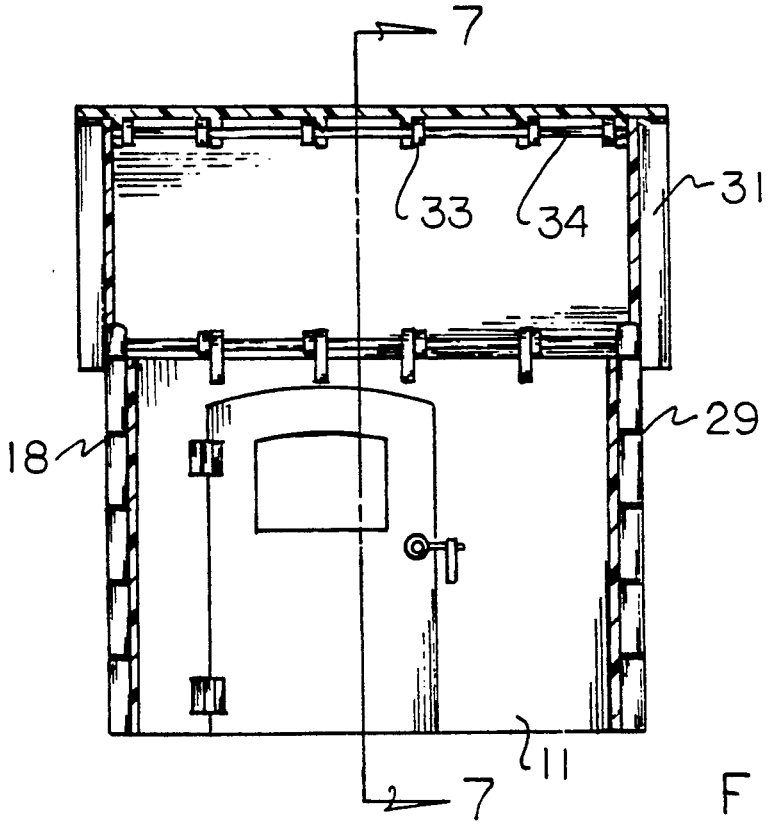
FIG 6

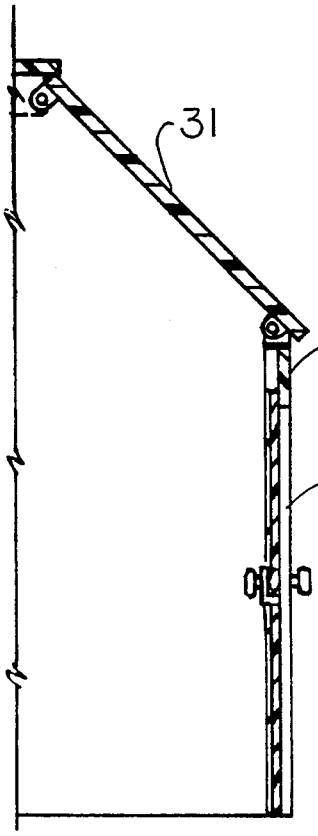
FIG 7
FIG 9
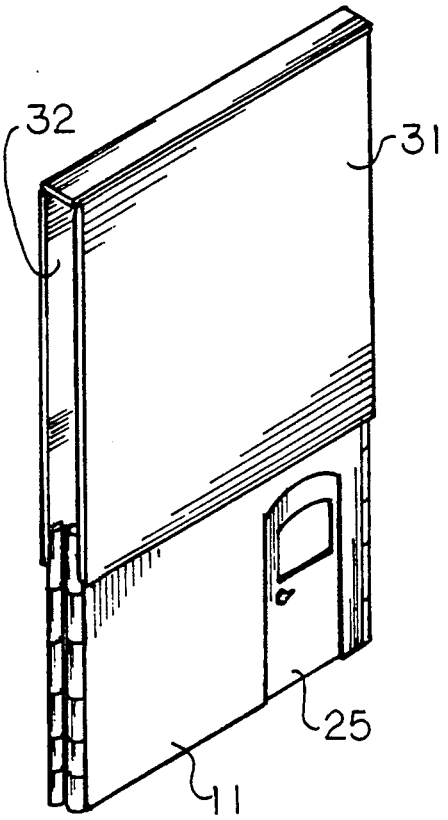
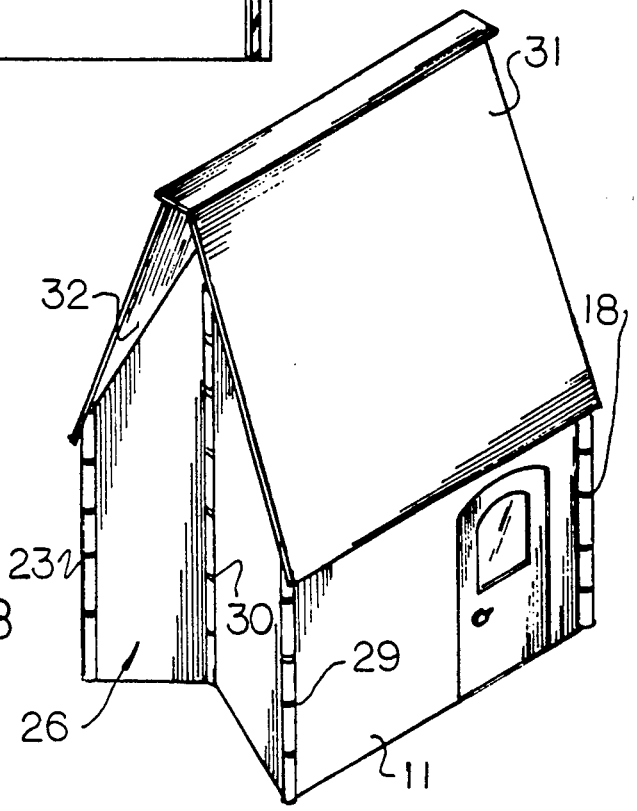
FIG 8

COLLAPSIBLE AND EXTENSIBLE PLAYHOUSE

BACKGROUND OF THE INVENTION

1. Field of the Invention

The field of invention relates to playhouse assemblies, and more particularly pertains to a new and improved collapsible and extensible playhouse wherein the same is arranged for ease of storage during periods of non-use and permitting the end walls to be oriented and projected in an orthogonal orientation between the front and rear walls.

2. Description of the Prior Art

Playhouse structure of various types are utilized throughout the prior art for the amusement and entertainment of children and the like. Such an organization is indicated in the U.S. Pat. No. 4,569,664 providing a playhouse structure arranged for ease of erection, with U.S. Pat. No. 4,964,249 indicating the use of a foldable playhouse having interfolded roof and side wall structures.

Further examples of children's playhouse structure is exemplified in U.S. Pat. Nos. 3,977,119 and 3,729,881.

The instant invention attempts to overcome deficiencies of the prior art by the particular positioning and arrangement of the hinge structure utilizing interdigited side portions of the front, rear, and end walls and in this respect, the present invention substantially fulfills this need.

SUMMARY OF THE INVENTION

In view of the foregoing disadvantages inherent in the known types of playhouse construction now present in the prior art, the present invention provides a collapsible and extensible playhouse wherein the same is arranged for ease of folding during periods of storage and ease of expansion of the wall structure for use. As such, the general purpose of the present invention, which will be described subsequently in greater detail, is to provide a new and improved collapsible and extensible playhouse which has all the advantages of the prior art playhouse structure and none of the disadvantages.

To attain this, the present invention provides a playhouse structure arranged to include a front and rear wall in a parallel orientation relative to one another, having first and second end walls. The first and second end walls are hingedly mounted intermediate their width and are hingedly mounted at each of their sides to the associated front and rear walls to permit projection of the first and second end walls intermediate the front and rear walls, with the roof structure having first and second roof plates hingedly mounted to the front and rear walls respectively and to one another. A modification of the invention includes crown trusses having projections projected through the roof plates and into one of the end walls to provide for a rigid structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved collapsible and extensible playhouse which has all the advantages of the prior art playhouse structure and none of the disadvantages.

It is another object of the present invention to provide a new and improved collapsible and extensible playhouse which may be easily and efficiently manufactured and marketed.

It is a further object of the present invention to provide a new and improved collapsible and extensible playhouse which is of a durable and reliable construction.

An even further object of the present invention is to provide a new and improved collapsible and extensible playhouse which is susceptible of a low cost of manufacture with regard to both materials and labor, and which accordingly is then susceptible of low prices of sale to the consuming public, thereby making such collapsible and extensible playhouse economically available to the buying public.

Still yet another object of the present invention is to provide a new and improved collapsible and extensible playhouse which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an isometric illustration, partially broken away, to indicate the hinged orientation of the roof plate structure relative to the front and rear walls.

FIG. 6 is an orthographic view taken along the lines 6—6 of FIG. 5 in the direction indicated by the arrows.

FIG. 7 is an orthographic view, taken along the lines 7—7 of FIG. 6 in the direction indicated by the arrows.

FIG. 8 is an isometric illustration of the invention indicating the wall structure in a partially collapsed configuration.

FIG. 9 is an isometric illustration of the invention with the playhouse in a folded configuration.

FIG. 10 is an isometric illustration of section 10, as set forth in FIG. 5.

DESCRIPTION OF THE PREFERRED EMBODIMENT

Figure 1:
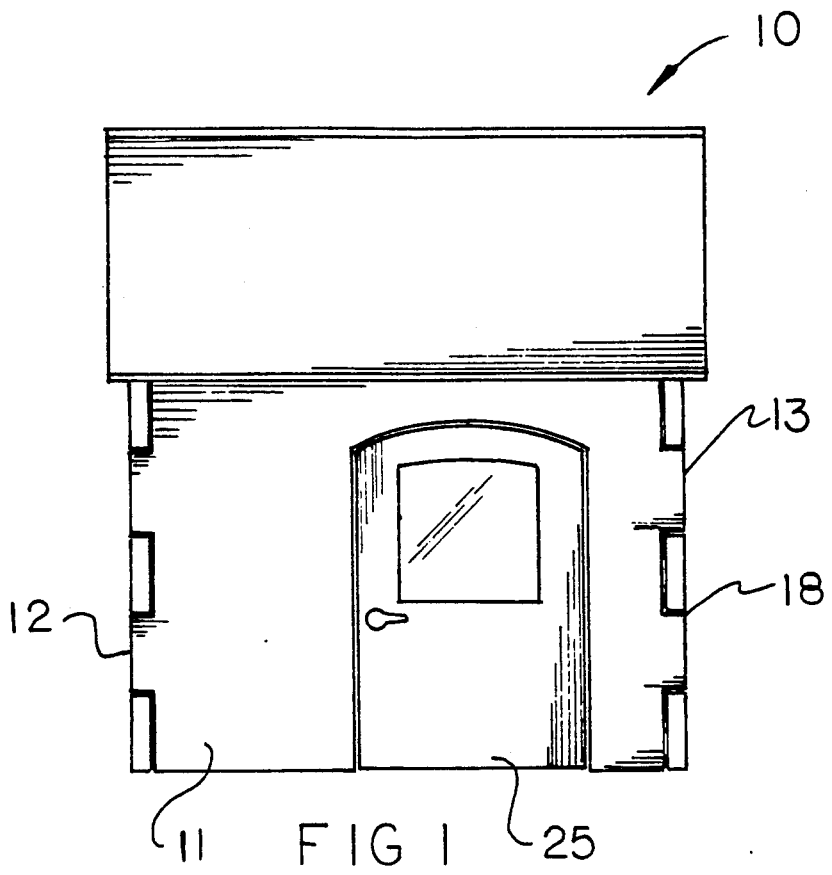
FIG. 1 is an orthographic front view of the invention.
Figure 2:
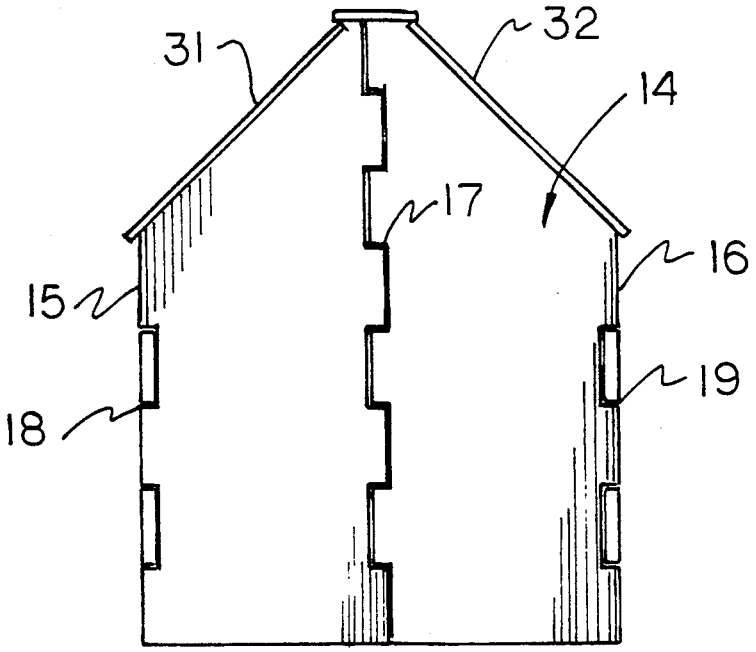
FIG. 2 is an orthographic end view of the invention.
Figure 4:
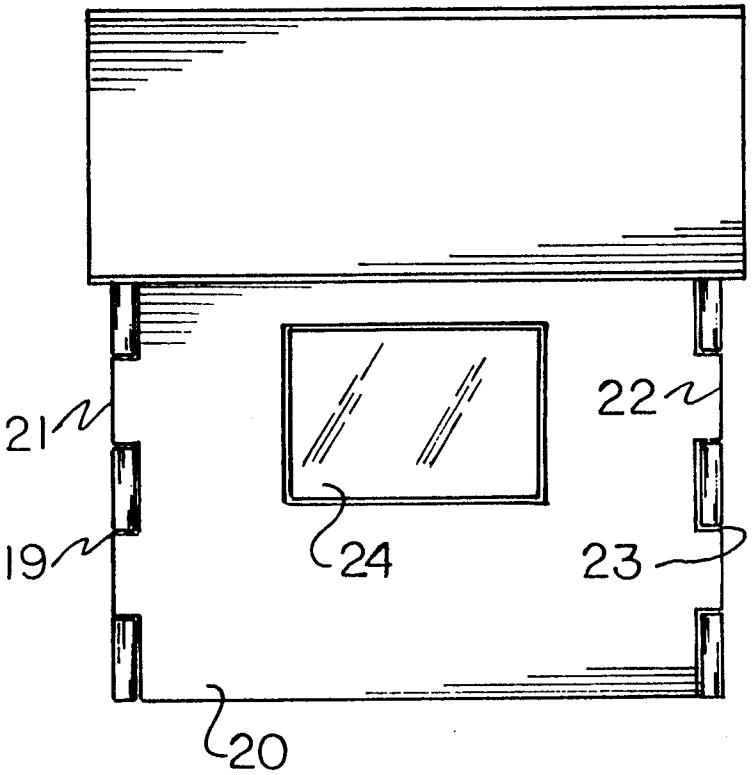
FIG. 4 is an orthographic rear view of the invention.

With reference now to the drawings, and in particular to FIGS. 1 to 12 thereof, a new and improved collapsible and extensible playhouse embodying the principles and concepts of the present invention and generally designated by the reference numeral 10 will be described.

More specifically, the collapsible and extensible playhouse 10 of the instant invention essentially comprises a front wall 11 having front wall first and second sides 12 and 13 respectively. A first end wall 14 (see FIG. 2) includes first end wall first and second sides 15 and 16 respectively, with the first end wall first side 15 interdigited with the front wall second side 13 to define a second first corner hinge 18. A first end wall 14 is provided with an intermediate hinge 17 parallel to the first hinge 18, with a second hinge 19 formed by interdigited connection of the first end wall second side 16 and a rear wall first side 21 to define the second corner hinge 19. A third corner hinge 23 is defined between the rear wall second side 22 and a second end wall 26 first side 27. For purposes of convenience, a transparent window member 24 is directed through the rear wall, wherein a door member 25 is pivotally mounted within the front wall for access interiorly of the playhouse structure. The second end wall 26 includes a second end wall intermediate hinge 30 and a fourth corner hinge 29 at the second end wall second side 28 and the front wall first side 12. It should be noted that all of the corner hinges 18, 19, 23, and 29, as well as the intermediate hinges 17 and 30 are arranged in a parallel relationship relative to one another to permit the interfolding of the end walls intermediate the front and rear walls, in a manner as indicated in FIG. 8.

Figure 3:
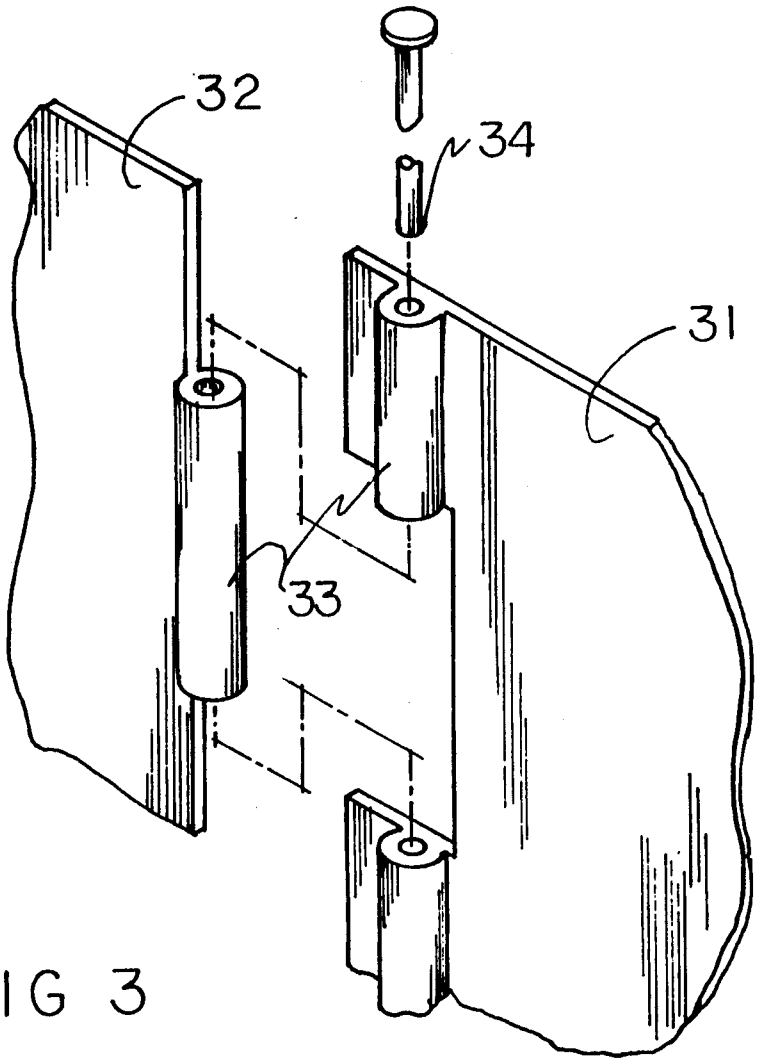
FIG. 3 is an isometric exploded illustration of the roof plates hingedly mounted relative to one another.

The roof structure of the invention includes a first roof plate 31 hingedly mounted to a second roof plate 32 about a first roof hinge 33 having a roof axle 34, as illustrated in FIG. 3 for example. A second roof hinge 35 (see FIG. 5) pivotally mounts the second roof plate 32 to the rear wall 20, with a third roof hinge 36 pivotally mounting the first roof plate 31 to the front wall 11.

In this manner, the playhouse structure may be interfolded from a first position, such as indicated in FIG. 1 for example, in any configuration, as indicated in FIG. 8, directing the end walls interiorly and between the front and rear walls to a third position, as indicated in FIG. 9, having an interfolded configuration.

Figure 12:
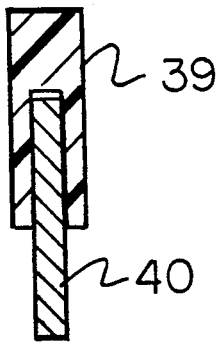
FIG. 12 is an orthographic view, taken along the lines 12—12 of FIG. 10*a* in the direction indicated by the arrows.
Figure 11:
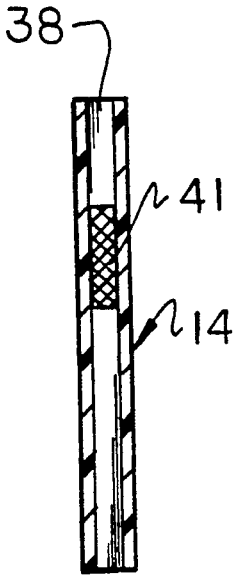
FIG. 11 is an orthographic view, taken along the lines 11—11 of FIG. 10*a* in the direction indicated by the arrows.
Figure 10A:
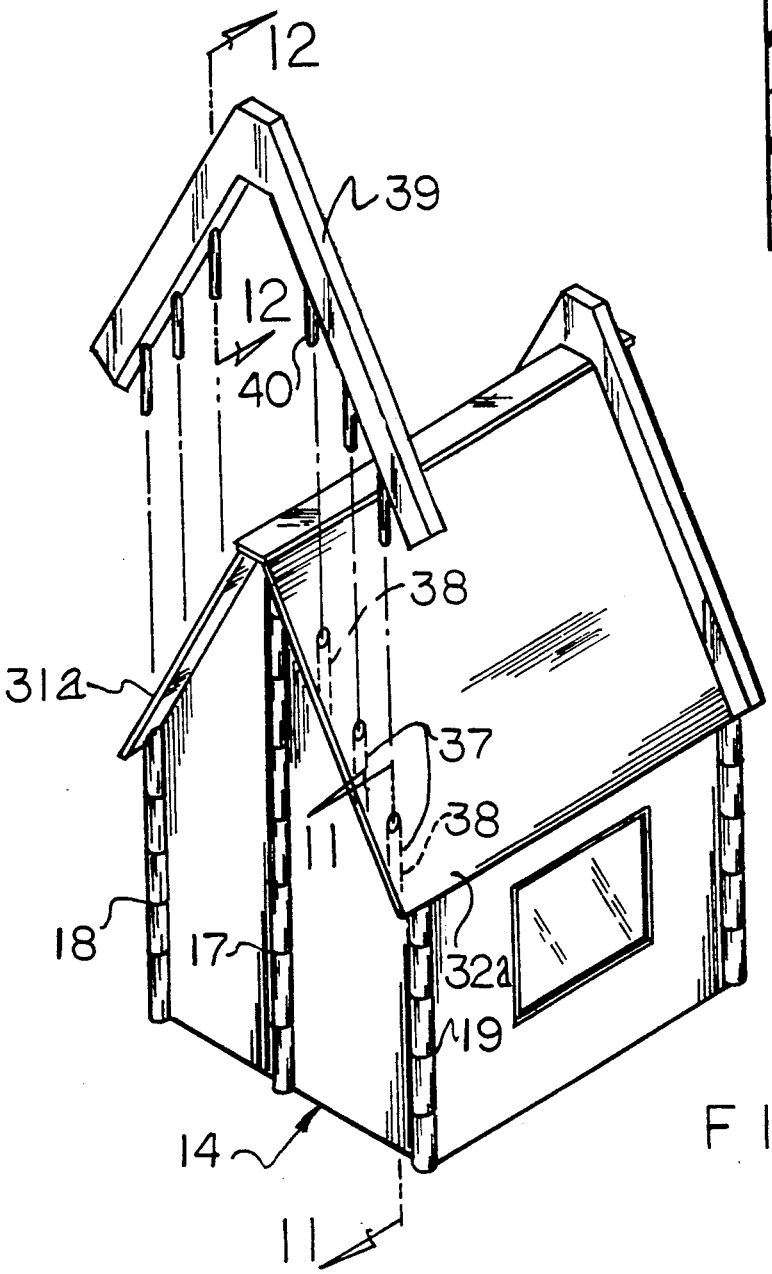
FIG. 10*a* is an isometric illustration of a modified aspect of the invention illustrating the use of locking roof crown members.

The FIGS. 10*a*, 11, and 12 indicate the use of the playhouse structure wherein the modified first roof plate 31*a* and the modified second roof plate 32*a* each include roof apertures 37 directed therethrough, with each of the roof apertures 37 aligned with one of a plurality of wall bores 38 within the end walls 14 and 26, as exemplified in the FIGS. 10*a*, 11, and 12. A plurality of crown ribs 39 are provided, with one of the crown ribs overlying each of the end walls and with the crown ribs 39 each having a series of rib rods 40, with each of the rib rods 40 directed through one of the roof apertures 37 and one of the wall bores 38 when the roof apertures and the wall bores are arranged in aligned orientation, as indicated in FIG. 10*a*. As indicated in 11, each of the wall bores 38 terminates in a magnetic plug 41 magnetically adhering each of the rib rods, with each of the rib rods 40 formed of a ferrous metallic material. In this manner, the rods 40 are each magnetically attracted within each of the wall bores 38 to insure securement of the crown ribs 39 relative to the roof structure to maintain the playhouse structure in a rigid and extended orientation, as indicated in FIG. 10*a*.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A collapsible and extensible playhouse, comprising, a front wall spaced from and parallel a rear wall, the front wall having a front wall first side and a front wall second side spaced from the front wall first side, the rear wall having a rear wall first side spaced from and parallel a rear wall second side, and a first end wall, the first end wall having a first end wall first side and a first end wall second side, the first end wall first side arranged in interdigited communication with the front wall second side, including a first corner hinge at a first intersection of the front wall second side and the first end wall first side, the rear wall first side arranged in interdigited securement to the first end wall second side to define a second corner hinge, and a second end wall having a second end wall first side and a second end wall second side, with the second end wall first side arranged in interdigited communication and securement to the rear wall second side defining a third corner hinge, and the second end wall second side arranged in interdigited communication with the front wall first side to define a fourth corner hinge, with each corner hinge arranged in a parallel relationship relative to one another, and the first end wall having a first end wall intermediate hinge intermediate and parallel the first corner hinge and the second corner hinge, with the second end wall having a second end wall intermediate hinge intermediate the third corner hinge and the fourth corner hinge, and a first roof plate and a second roof plate, with the first roof plate hingedly mounted to the second roof plate at a first roof hinge, and a second roof hinge hingedly mounting the roof plate to the rear wall, and a third roof hinge hingedly mounting the first roof plate to the front wall, wherein the first roof hinge, the second roof hinge, and the third roof hinge are arranged parallel relative to one another, and are orthogonally oriented relative to the first corner hinge, the second corner hinge, the third corner hinge, and the fourth corner hinge, and the first end wall and the second end wall each include a plurality of spaced wall bores directed therein, and the first roof plate and the second roof plate each include a plurality of apertures directed therewithin, and each of the roof apertures is arranged for alignment with one of said wall bores, and at least one crown rib, the at least one crown rib includes a plurality of ferrous metallic rib rods fixedly mounted to the crown rib, and wherein the crown rib is arranged to overlie the first roof plate and the second roof plate, and each of the wall bores includes a magnetic plug therewithin in magnetic adherence to each of the ferrous metallic rib rods when the at least one crown rib is arranged in contiguous communication with the first roof plate and the second roof plate, with each of the rib rods extending through one of said roof apertures and one of said wall bores.

* * * * *